US006260900B1

(12) United States Patent
Scott

(10) Patent No.: US 6,260,900 B1
(45) **Date of Patent: *Jul. 17, 2001**

(54) UNIVERSAL ANCHOR FOR HOISTING ASSEMBLY

(75) Inventor: Robin L. Scott, Houston, TX (US)

(73) Assignee: Universal Form Clamp, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,379

(22) Filed: Mar. 29, 1999

Related U.S. Application Data

(63) Continuation of application No. 09/028,379, filed on Mar. 29, 1999, now Pat. No. 5,993,190.

(51) Int. Cl.[7] ..... B66C 1/66

(52) U.S. Cl. ..... 294/89; 294/1.1; 52/125.4

(58) Field of Search ..... 294/1.1, 82.1, 294/89; 52/125.4, 125.5, 698, 704, 707; 410/101

(56) References Cited

U.S. PATENT DOCUMENTS

| | | | | |
|---|---|---|---|---|
| Re. 033,881 | | 4/1992 | Courtois et al. | 294/89 |
| 956,938 | * | 5/1910 | Ciardelli | 294/89 |
| 2,886,370 | * | 5/1959 | Liebert | 294/89 |
| 4,173,856 | | 11/1979 | Fricker | 52/125 |
| 4,437,642 | | 3/1984 | Holt | 249/175 |
| 4,634,164 | | 1/1987 | Fricker | 294/89 |
| 4,671,554 | | 6/1987 | Lancelot | 294/89 |
| 5,469,675 | * | 11/1995 | Arteon | 52/125.5 |
| 5,596,846 | * | 1/1997 | Kelly | 52/125.4 |

FOREIGN PATENT DOCUMENTS

| | | | | |
|---|---|---|---|---|
| 2382398 | | 2/1978 | (FR) . | |
| 1437010 | * | 5/1976 | (GB) | 294/89 |
| 981-187 | * | 12/1982 | (SU) | 294/89 |

OTHER PUBLICATIONS

Brochure—The Burke Group, "Burke Super–Lift III Tilt–up System" (No Date).

Brochure—The Burke Group, "Burke Super–Lift III The Complete Tilt–up System", 1997.

Brochure—Dayton Superior Corporation, "Dayton/Richmond Concrete Accessories, Precast Construction Handbook, Precast Lifting System", 1998, Cover and pp. 5, 13–14 & 16.

Brochure—Richmond Screw Anchor Co., "Richmond—Products for Precast Concrete Construction", 1993, cover and p. 3.

Product Sheet—Dayton Superior, "Swift Lift System—P–53 SL Lifting Eye Anchor for Lifting and Handling" (No Date).

* cited by examiner

*Primary Examiner*—Dean J. Kramer
(74) *Attorney, Agent, or Firm*—Felsman, Bradley, Vaden, Gunter & Dillon, LLP; Frank S. Vaden, III; Constance Gall Rhebergen

(57) ABSTRACT

The current invention is a universal anchor for use with both ring clutches and bail lift clutches. The invention includes an anchor with a nail-shaped head on one end of a shaft and a flattened plate with at least one perforation through the plate on the other end of the shaft. When embedded in concrete with the nail-shaped head exposed, the anchor is available for engagement with bail lift clutches. When embedded in concrete with the perforated plate end exposed, the anchor is available for engagement with ring clutches. In this manner, one universal anchor may be used regardless of the type of clutch available.

8 Claims, 2 Drawing Sheets

UNIVERSAL ANCHOR FOR HOISTING ASSEMBLY

This application is a continuation of application Ser. No. 09/028,379, filed Mar. 29, 1999, now U.S. Pat. No. 5,993,190.

BACKGROUND OF THE INVENTION

1. Field of the Invention

The current invention relates generally to lifting of precast concrete elements and more particularly to the anchor or insert embedded into the concrete element as part of a hoisting assembly.

2. Description of the Prior Art

A hoisting assembly for lifting and tilting precast concrete blocks for construction is known in the art. Tilt-up construction has become a widely accepted economic method of producing and installing building elements. Frequently, concrete elements are created in a centralized location such as a prefabrication factory or precast yard and then transported to the building site. For purposes of transportation of the elements, hoisting assemblies are used. When these concrete elements are created on site or arrive on site, hoisting assemblies are use to reorient the elements and move them into place. Numerous patents relate to the hoisting assembly as a whole, such as U.S. Pat. No. 4,634,164 and U.S. Pat. No. 4,173,856 issued to Fricker. In such cases, anchors or inserts are cast into the concrete elements for engagement with a clutch of the hoisting assembly. The anchor disclosed in each of these patents is positioned below the edge surface of the precast concrete so that the concrete holds the anchor in place. The anchor has an exposed portion for engagement with the clutch. The anchor can simply extend above the precast concrete or can extend from an engagement recess formed in the precast element. Engagement recesses are generally formed by inserting a cap during the casting of the block, the cap being removed afterwards to define the recess. This engagement recess prevents bearing against the edge surface of the concrete. The anchor is intended to be permanently embedded in the concrete element, in most cases, with the end portion exposed within its recess.

While the anchor alone is cast into the concrete, bases are also used in conjunction with the anchors to further stabilize the anchor within the concrete. These bases or cages are generally plastic assemblies with legs. The plastic goes around the anchor and helps distribute forces such that the anchor is less likely to pull out of the concrete. Additionally, the insertion of a cross bar through a hole in the anchor embedded in the concrete is useful to further stabilize the anchor within the block. The base and the bar serve the purpose of rigidly retaining the anchor in the precast concrete element when embedded therein.

While all hoisting assemblies include an anchor and a clutch, hoisting assemblies can be divided into two categories based on their type of clutch. The first type of clutch is a "ring clutch". This clutch has a locking bolt or latch within a torus or donut-shaped ring. The bolt engages with an opening in one end of an anchor to connect the ring clutch to the anchor for hoisting the precast concrete element. The second type of clutch is a "bail lifter" where the clutch surrounds and contains the end of the anchor for lifting.

Examples of ring clutches and the anchors useful for engaging with such ring clutches to complete the hoisting assemblies are disclosed in U.S. Pat. No. 4,632,164 by Fricker, and U.S. Pat. No. 4,437,642 by Holt. Each of these hoisting assemblies includes a ring clutch with a moveable bolt for engaging a recess in an anchor.

Examples of hoisting assemblies with bail lifter variety clutches and the anchors useful in such hoisting assemblies include U.S. Pat. No. 4,700,979 by Courtois through its related Re. 33,881, and U.S. Pat. No. 4,671,554 issued to Lancelot. Each of these discloses a bail lifter with a socket in a coupler body for receiving and containing an anchor. As shown incidentally in these patents, anchors are known with ends in the shape of balls or nail-heads. Again, the bail lifter type clutch and the anchor together create the hoisting assembly.

As noted above, each type of clutch requires a specific type of anchor for interaction. The ring clutch variety requires an anchor type with an exposed hole for engagement with the bolt of the clutch. The bail lifter variety requires a wide head on the anchor to be contained within the clutch. These anchors are not interchangeable.

Different types of anchors and hoisting arrangements are chosen depending upon the type of precast concrete element or the lifting arrangement. For example, some elements are relatively thin, and some are created from lightweight concrete. Likewise, while some elements are lifted from an anchor in the face of the element, some are lifted from the edge. As the physical stresses on the concrete element differ in each case, a variety of hoisting assembly types are use. For each type of clutch used, a matching anchor is required.

In other cases where the type of hoisting assembly needed is not dictated by the parameters of the precast element, a limitation can arise due to a shortage of one type of hoisting clutch on the work site. For example, a job site where concrete elements are cast may have an adequate supply of anchors for use with ring clutches but not with bail lifters. If ring clutches are in short supply, additional anchors for engagement with the bail lifter must be ordered and delivered. There is always the possibility that this may cause delay, a serious problem for construction teams often resulting in large financial losses.

Similarly, a pre-cast yard receives specifications from the job site dictating that anchors be used that are compatible with the hoists on the job-site. Traditionally, pre-cast yards maintain a large inventory of anchors to accommodate these orders. The difficulty of the lack of interchangeability of anchors for the two clutch types results in inefficiencies. There is a need for one universal anchor that is adapted to be interchangeable between different types of clutches Furthermore, anchors of the nail-head type are traditionally stamped out of pressed steel. Examples of manufacturers of such include anchors distributed by Richmond - Dayton Superior and Meadows Burke (the Ultra Lift system). While the incremental cost of each stamped anchor is relatively low, the capital investment in the equipment is extemely high. There is a need for a simpler and less capital intensive manufacturing process to create a malleable anchor.

It is an object and feature of the current invention to provide a universal anchor that can engage with more than one type of clutch of a hoisting assembly.

It is a further object of the invention to provide an anchor of malleable material that allows for ease and economies of manufacture.

BRIEF SUMMARY OF THE INVENTION

The present invention is a universal anchor for precast concrete elements useful in tilt-up construction. These anchors engage with hoisting assemblies for lifting and rotating. The universal anchor of the present invention includes a shaft with a first end and a second end. On the first end of the shaft is a head with a diameter greater than shaft diameter. In a preferred embodiment, the head resembles the head of a nail with the head having a flat face such that a longitudinal axis drawn through the shaft is perpendicular to such face. The second end of the shaft has a foot that has an aperture adapted to receive an engaging bolt of a hoisting assembly clutch. The foot of the second end has two essentially parallel surfaces aligning with the longitudinal axis of the shaft. The aperture extends completely through the second end such that the aperture communicates between the two surfaces. The foot of the second end has a width greater than the diameter of the shaft such that the faces extend out beyond the shaft while the depth of the foot is similar to the diameter of the shaft. While this anchor can be cast directly into concrete elements, an alternate embodiment includes mounting a base to the anchor such that the base and the anchor are permanently inserted into the concrete element. This base is such that it assists to rigidly retain the anchor in the precast concrete element. Another preferred embodiment of the invention includes a removable cap for forming a recess in the concrete around that end of the anchor which is exposed. A preferred embodiment of the invention includes forging the universal anchor from a malleable material.

For additional resistence when the foot is cast into the concrete, a tension bar is mounted through the aperture of the foot.

The structure of the present invention as well as other features, advantages, benefits and objects thereof over other designs known in the art may be better understood with reference to the detailed description which follows in conjunction with the drawings.

DETAILED DESCRIPTION OF THE INVENTION

Figure 1:
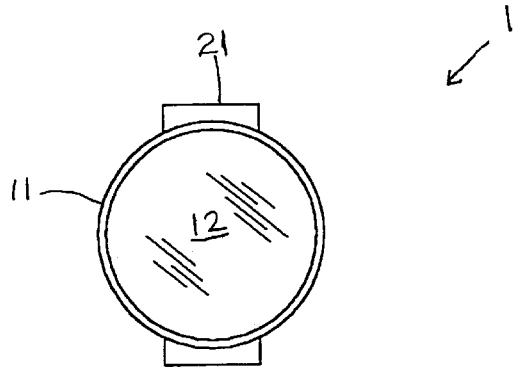
FIG. 1 is an end view of the first end of the universal anchor.
Figure 2:
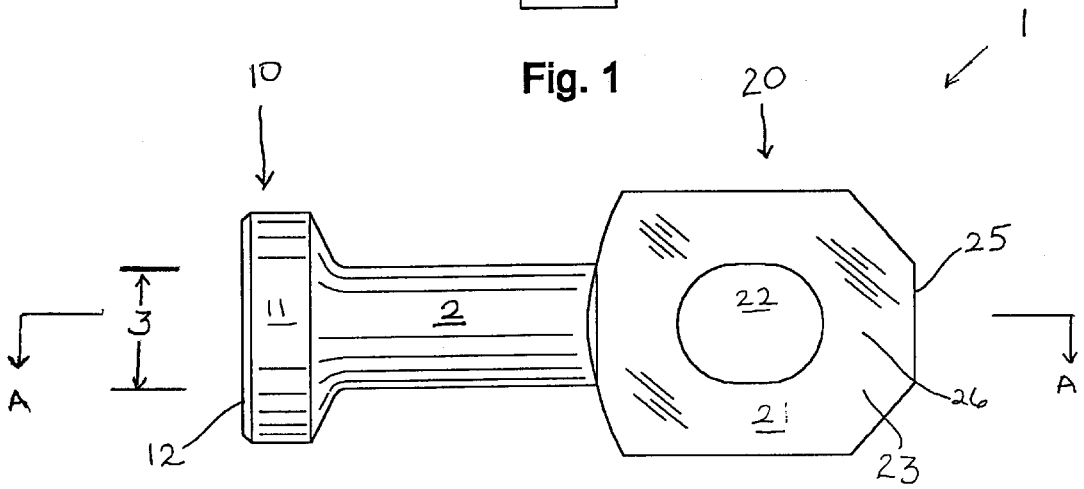
FIG. 2 is a side elevational plan view of the universal anchor of the present invention.
Figure 3:
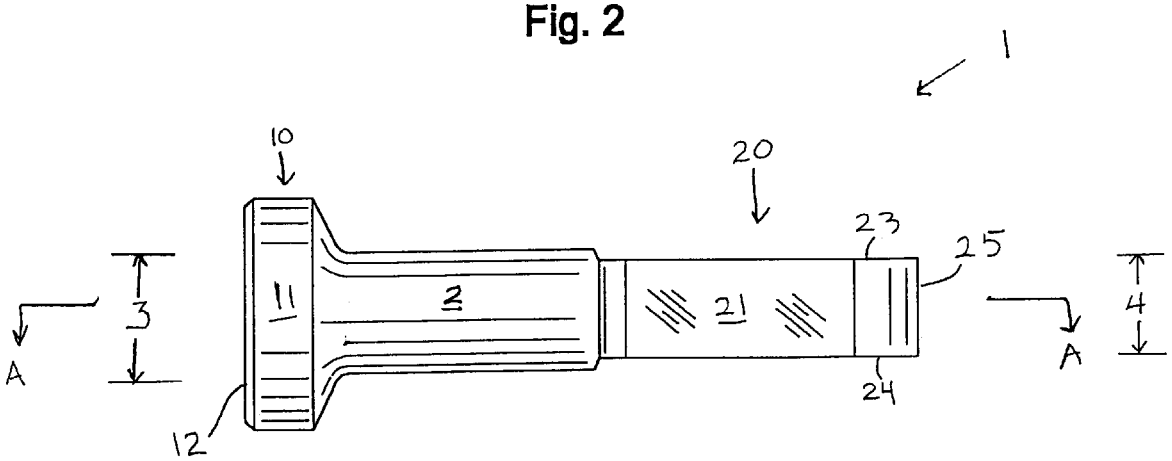
FIG. 3 is a plan view of the universal anchor of the present invention as shown in FIG. 2, rotated around axis A—A.
Figure 4:
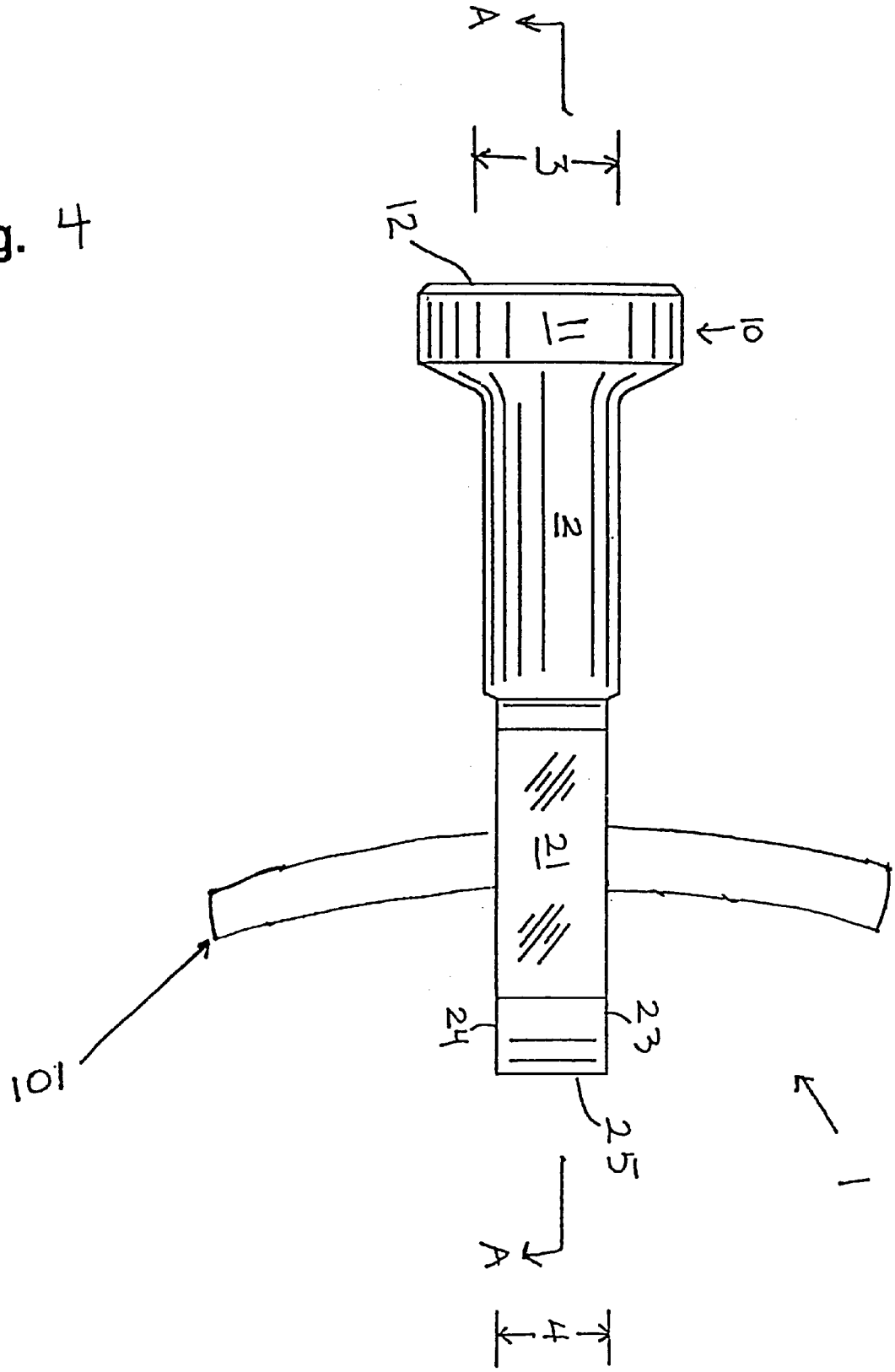
FIG. 4 is a side elevation of the anchor with a tension bar mounted through the aperture of the foot.

Referring to the drawings, FIGS. 1–3 depict one preferred embodiment of the universal anchor 1 of the invention. The anchor is cast into the concrete elements in the direction necessary for engaging the exposed section with the hoisting assembly clutch of either the ring clutch or the bail lifter variety. The anchor includes shaft 2 which has shaft diameter 3. The shaft has first end 10 and second end 20. The diameter of first end 10 is greater than shaft diameter 3 such that head 11 is formed. FIG. 1 shows head 11 as having circular flat face 12 resembling the head of a nail. Flat face 12 is largely perpendicular to longitudinal axis A—A of shaft 2. When universal anchor 1 is cast into concrete such that head 11 protrudes from the concrete, the anchor is in place for engagement with a bail lift type shackle.

Shaft diameter 3 is preselected to accommodate load requirements. For example, diameter of three-quarters inch is useful for loads with design capacity of fifteen thousand pounds. Larger diameters can be used to accommodate greater loads.

The size of head 11 is preselected to accommodate, not only load requirements, but engagement with common bail lift type shackles. For example, sizing the head to have a diameter around or slightly less than one and a half inches allows the anchor head to engage with numerous commercial bail lift shackles used on job sites. The universal anchor can also be reversed such that head 11 is embedded in concrete with second end 20 protruding from the concrete element. In this case, the size of head 11, coupled with the length of shaft embedded in the concrete, relates directly to the resistivity of the concrete in the form of a full shear cone to avoid pull-out. A full shear cone is a conical area relative to the diameter of head 11 that is pulled out of the concrete when the concrete fails around the anchor. Thus, in the above example, the head diameter of slightly less than one and a half inches not only allows for engagement with common bail lift type shackles, but also sufficiently resists pull-out for lifting up to 15,000 pounds. The above example relates to normal weight concrete with the anchor placed properly in relation to the edges of the concrete element to develop resistivity for the design weight. An example of proper placement includes embedding the anchor such that approximately seventy percent (70%) of the anchor is in contact with the concrete. For this example, a common or average length from head to foot of the universal anchor is about five inches. Other diameters of head 11 can be preselected based upon conditions. Likewise, a base (not shown) may be added to head 11 when the head is embedded in the concrete, such base being useful to further distribute forces resulting in greater resistivity to pull-out and development of a larger full shear cone.

Second end 20 has foot 21. With the universal anchor of this invention, foot 21 can be cast into concrete such that foot 21 is protruding from the concrete element to engage with the ring clutch, or such that foot 21 is embedded in the concrete. Foot 21 defines aperture 22 which is adapted to receive the retractable latch of the ring clutch as part of the hoisting assembly when foot 21 is exposed from the concrete. Foot 21 has two essentially parallel surfaces, 23 and 24, such that width 4 is defined between these surfaces. Width 4 is preselected to accommodate those ring clutches commonly used with specific slot widths for engagement with anchors. Like width 4, aperture 22 is selected and placed to accommodate common ring clutches. Aperture 22 extends transversely through foot 21, the aperture being of a size to allow insertion of a locking bolt there through and arranged at such a distance from extremity 25 that bridge portion 26 is formed between the aperture and the extremity.

When foot 21 is embedded in the concrete, the foot serves to distribute the weight and create the resistivity to the concrete to avoid pull-out as described above. Again, this resistivity is related to the area of the foot such that a full cone shear is developed. While the foot itself is sufficient to create this resistivity, there are specific instances of use when greater resistance to tension is desirable. Aperture 22 allows the addition of the tension bar 101 through the aperture such that the tension bar extends on both sides of longitudinal axis A—A beyond surfaces 23 and 24. Bars can also be welded to the shaft to spread out forces exerted on the concrete around the anchor. Likewise, the addition of a base in addition to or in place of the bar can also be used to enhance resistivity to pull-out.

A different base is used depending upon which end of the universal anchor is inserted into the concrete. While a base is not always necessary or even desirable under specific circumstances, there are those precast elements which benefit from an anchor base. In such a case, the anchor is gripped by a portion of the anchor that is inserted into the concrete by a gripping element shaped to receive that portion as part of the base. The portion gripped can be the shaft, first end or second end, depending on the orientation of the anchor and the type of base used.

Caps are frequently used in the industry to create a void around the exposed end of the anchor so that the anchor has an exposed section available for engagement with the appropriate type of hoist without allowing the anchor to extend beyond the face of the concrete element. Alternately, anchors are cast without voids, thus allowing the anchor to protrude from the finished concrete element. The universal anchor of the current invention is useful in either situation.

Currently, anchors are created by stamping them out of a material, such as carbon steel. These stamped anchors typically become brittle when heated then cooled. For this reason, anchors commercially available warn against welding additional elements to the anchor on the job site. While the anchor of the current invention can be tooled by stamping as is common in the art, capital investment in equipment necessary to stamp anchors is intensive. The present invention includes creating the universal anchor from a forgeable material such as st-52.3 steel. This not only provides efficiencies by removing the necessity of large up-front capital investment, but also creates an anchor that can be heated without losing integrity and without becoming brittle. This is particularly important if the anchor is to have an additional plate or bar welded in place.

From the foregoing it will be seen that this invention is one well adapted to attain all of the ends and objects herein above set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

For example, while the figures depict the universal anchor having one aperture, multiple apertures can be used. In this manner, additional reinforcing bars can be added at varying heights or varying diameters. Likewise, multiple apertures make the universal anchor adaptable to additional ring clutches that do not align with one aperture or which could have two rings.

What is claimed is:

1. A universal anchor for precast concrete elements for engaging with hoisting assembly clutches, including a bail lifter variety clutch or a ring clutch, comprising:

a shaft having a first end and a second end, said shaft having a shaft diameter, the first end having a head of diameter greater than the shaft diameter, said head being dimensioned to lockingly engage the bail lifter variety clutch, the second end having a foot, said foot defining an aperture dimensioned to lockingly engage the ring clutch, the universal anchor being reversible such that either end can extend from the element for engagement with the hoisting assembly clutch.

2. The universal anchor of claim 1 wherein the head of the first end has a flat face, said face being perpendicular the longitudinal axis of the shaft.

3. The universal anchor of claim 1 wherein the foot of the second end has two essentially parallel surfaces aligning with the longitudinal axis of the shaft, said aperture communicating between the two parallel surfaces.

4. The universal anchor of claim 3 wherein the foot of the second end has a width, said width being greater than the diameter of the shaft.

5. The universal anchor of claim 1 wherein the anchor is of a forgeable material.

6. The universal anchor of claim 1 further comprising:

a tension bar mounted through the aperture of the foot.

7. The universal anchor of claim 1 wherein the head of the first end has a generally round, flat face, said face being perpendicular the longitudinal axis of the shaft.

8. The universal anchor of claim 7 wherein the foot of the second end has two essentially parallel surfaces aligning with the longitudinal axis of the shaft, said aperture communicating between the two parallel surfaces.

* * * * *